US005385444A

United States Patent [19]

Kobayashi et al.

[11] Patent Number: 5,385,444

[45] Date of Patent: Jan. 31, 1995

[54] PUMP CASING MADE OF SHEET METAL

[75] Inventors: Makoto Kobayashi; Masakazu Yamamoto; Yoshio Miyake, all of Kanagawa, Japan

[73] Assignee: Ebara Corporation, Tokyo, Japan

[21] Appl. No.: 45,686

[22] Filed: Apr. 14, 1993

[30] Foreign Application Priority Data

Apr. 14, 1992 [JP] Japan ..... 4-120177
Jul. 6, 1992 [JP] Japan ..... 4-201988

[51] Int. Cl.[6] ..... F04D 29/40

[52] U.S. Cl. ..... 415/182.1; 415/200; 415/203; 415/208.2

[58] Field of Search ..... 415/182.1, 203, 208.1, 415/208.2, 214.1, 200

[56] References Cited

U.S. PATENT DOCUMENTS

| | | | |
|---|---|---|---|
| 2,381,824 | 8/1945 | La Bour | 415/171.1 |
| 3,395,644 | 8/1968 | Grebel et al. | 415/171.1 |
| 3,619,075 | 11/1971 | Chmela | 415/121.2 |
| 3,874,813 | 4/1975 | Honold et al. | 415/182.1 |
| 4,050,846 | 9/1977 | Metzinger et al. | 415/182.1 |
| 4,448,573 | 5/1984 | Franz | 415/182.1 |
| 4,549,849 | 10/1985 | Jensen et al. | 415/182.1 |
| 5,030,061 | 7/1991 | Meissgeier | 415/214.1 |
| 5,205,725 | 4/1993 | Pattison | 415/121.2 |

FOREIGN PATENT DOCUMENTS

| | | | |
|---|---|---|---|
| 30901 | 3/1977 | Japan | 415/214.1 |
| 114805 | 9/1979 | Japan | 415/214.1 |
| 156497 | 12/1981 | Japan | 415/203 |
| 195496 | 8/1987 | Japan | 415/214.1 |
| 1434574 | 5/1976 | United Kingdom | 415/182.1 |

*Primary Examiner*—John T. Kwon
*Attorney, Agent, or Firm*—Oblon, Spivak, McClelland, Maier & Neustadt

[57] ABSTRACT

A pump casing made of sheet metal has a substantially cylindrical cup-shaped sheet-metal pump casing having a bottom on one axial and thereof and an opening defined in an opposite axial end thereof. The interior of the pump casing is divided by a partition wall disposed therein into a suction chamber and a hydrocasing chamber with an impeller rotatably housed therein. A suction nozzle is mounted on a cylindrical side wall of the pump casing and communicates with the suction chamber. The partition wall is joined to the bottom of the pump casing. The suction nozzle is positioned over the suction and hydrocasing chambers.

26 Claims, 9 Drawing Sheets

PUMP CASING MADE OF SHEET METAL

BACKGROUND OF THE INVENTION

1. Field of the Invention

The present invention relates to a pump casing made of sheet metal, and more particularly to a pump casing made of sheet metal and having a partition wall that divides the interior space of the pump casing into a suction chamber and a hydrocasing chamber.

2. Description of the Related Art

There have been known line pumps having a pump casing formed by pressing sheet steel such as stainless steel according to a deep drawing process.

One conventional line pump having a sheet-metal pump casing will be described below with reference to FIGS. 9 and 11 of the accompanying drawings. As shown in FIGS. 9 and 11, a line pump 71 has a sheet-metal pump casing 72 formed by pressing sheet steel such as stainless steel. As shown in FIG. 10, the pump casing 72 has a partition plate 73 that divides the interior space of the pump casing 72 into a suction chamber 74 and a hydrocasing chamber 75. In this specification, a hydrocasing chamber is defined as a chamber in which an impeller is disposed and a discharge pressure is developed. The line pump 71 also has an impeller 76 rotatably disposed in the hydrocasing chamber 75. The impeller 76 is fixedly supported on the free end of a shaft 77 of a motor M with a shaft seal 79 interposed between the shaft 77 and a casing cover 78.

The pump casing 72 has a suction port 80 communicating with the suction chamber 74 and a discharge port 81 communicating with the hydrocasing chamber 75. The pump casing 72 also has a suction flange 82 and a discharge flange 83 which are disposed around the suction port 80 and the discharge port 81, respectively.

As shown in FIGS. 9 and 10, the suction port 80 and the discharge port 81 have respective axes extending perpendicularly to the shaft 77, and are positioned diametrically opposite to each other across the shaft 77. The suction chamber 74 has a suction passage extending from the suction port 80 to an inlet region of the impeller 76. As shown in FIG. 10, the hydrocasing chamber 75 which houses the impeller 76 includes a discharge passage of a complex shape, such as a volute shape or the like, which extends from an outlet region of the impeller 76 to the discharge port 81. The suction chamber 74 also has a complex configuration because of a complex relative position between the suction port 80 and the inlet region of the impeller 80 as shown in FIGS. 9 and 10.

For fabricating the conventional line pump, it has been customary to separately produce the hydrocasing chamber 75 with the partition plate 73, and the substantially elliptical-shaped suction casing 72, and to weld the partition plate 73 and the suction casing 72 to each other. Alternatively, various components which form part of the suction chamber 74 and the discharge chamber 75 are welded to the partition plate 73.

SUMMARY OF THE INVENTION

It is therefore an object of the present invention to provide a pump casing made of sheet metal that can easily be pressed to shape, has a hydrocasing chamber and a suction chamber which are separated from each other by a partition wall of a simple shape, and is made up of a relatively small number of parts that can easily be welded together.

According to the present invention, there is provided a pump casing made of sheet metal, comprising a substantially cylindrical cup-shaped pump casing made of sheet metal and having a bottom on one axial end thereof and an opening defined in an opposite axial end thereof; a partition wall disposed in said pump casing for partitioning said pump casing into a suction chamber and a hydrocasing chamber for accommodating an impeller, said partition wall being connected to said bottom of said pump casing; and a suction nozzle mounted on a cylindrical side wall of said pump casing and communicating with said suction chamber.

The suction nozzle is positioned outside of the suction and hydrocasing chambers. The pump casing further comprises a discharge nozzle mounted on the cylindrical side wall of the pump casing and positioned outside of the suction and hydrocasing chambers. The cylindrical side wall has a suction port defined therein which provides communication between the suction chamber and the suction nozzle, and discharge port defined therein which provides communication between the hydrocasing chamber and the discharge nozzle.

Each of the suction nozzle and the discharge nozzle has a smaller-diameter portion and a larger-diameter portion extending therefrom and connected to the cylindrical wall, the suction and discharge ports are positioned on opposite sides of the plane of the partition wall, and each of the suction and discharge ports has a substantially semicircular shape having a center of curvature near the partition wall.

The pump casing also includes an inner casing disposed in the pump casing in spaced relationship thereto, the impeller is housed in the inner casing, and a resilient seal is disposed in a gap defined between the inner casing and the partition wall.

BRIEF DESCRIPTION OF THE DRAWINGS

The above and other objects, features, and advantages of the present invention will become apparent from the following description when taken in conjunction with the accompanying drawings which illustrate preferred embodiments of the present invention by way of example:

FIG. 3(*b*) is a cross-sectional view taken along line III(*b*)—III(*b*) of FIG. 3(*a*);

FIG. 4(*b*) is a cross-sectional view taken along line IV(*b*)—IV(*b*) of FIG. 4(*a*);

FIG. 5(*b*) is a cross-sectional view taken along line V(*b*)—V(*b*) of FIG. 5(*a*);

FIG. 6(*b*) is a side elevational view of a discharge port as viewed in the direction indicated by the arrow VI(*b*) in FIG. 1;

FIG. 8(*b*) is a perspective view of a side-top type of pump casing shown in FIG. 7;

DETAILED DESCRIPTION OF THE PREFERRED EMBODIMENTS

Figure 1:
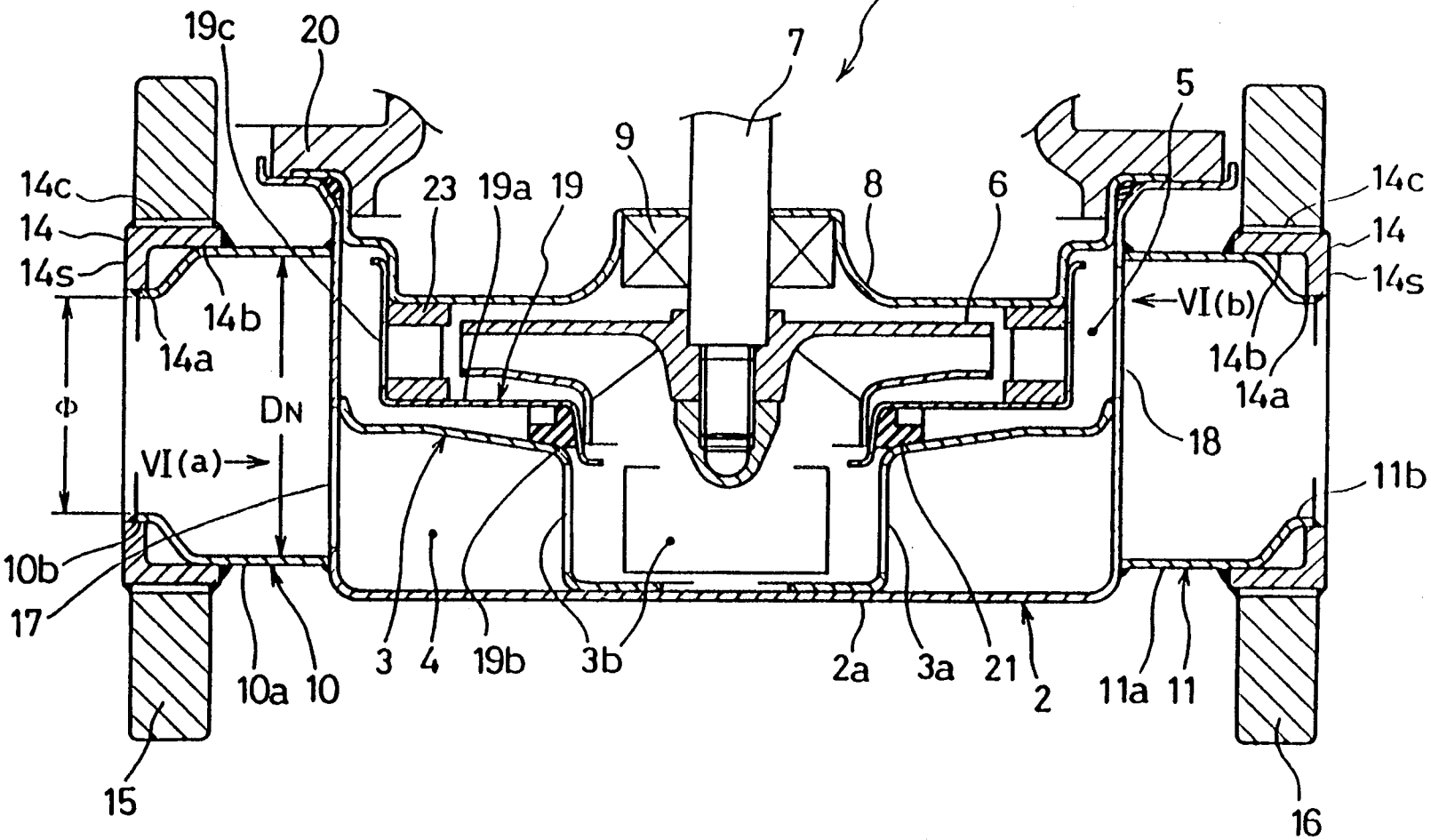
FIG. 1 is a vertical cross-sectional view of a pump casing made of sheet metal according to an embodiment of the present invention.

A pump casing made of sheet metal according to an embodiment of the present invention will be described below with reference to FIGS. 1 through 6. FIG. 1 shows a line pump having a pump casing of the present invention.

Figure 2:
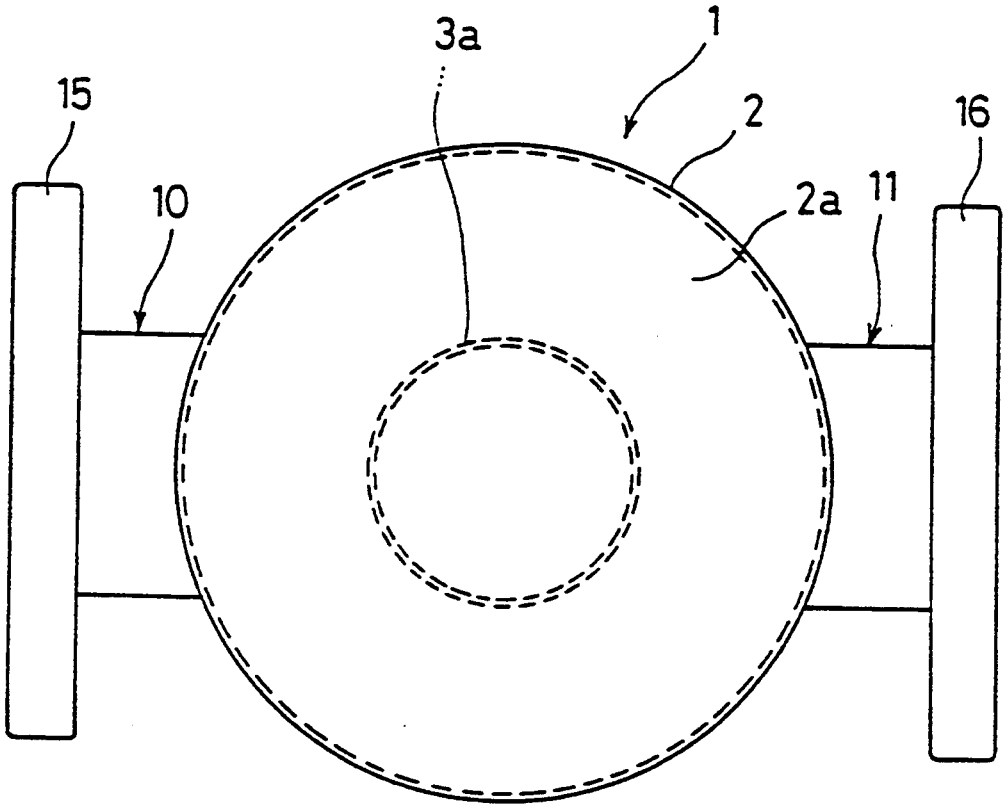
FIG. 2 is a bottom view of the pump casing made of sheet metal shown in FIG. 1.

As shown in FIGS. 1 and 2, a line pump 1 has a sheet-metal pump casing 2 formed by pressing sheet steel such as stainless steel. The pump casing 2 is in the form of a substantially cylindrical cup-shaped outer casing having a bottom 2*a* on one axial end and an opening in the other axial end. The pump casing 2 has a partition wall 3 that divides the interior space thereof into a suction chamber 4, and a hydrocasing chamber 5. The hydrocasing chamber 5 houses a rotatable impeller 6 fixedly supported on the free end of a shaft 7 of a motor (not shown) which projects into the hydrocasing chamber 5 through the opening in the other axial end of the pump casing 2. A shaft seal 9 is interposed between the shaft 7 and a casing cover 8 that is attached to the other axis and of the pump casing 2 in covering relationship to the opening thereof.

Figure 3A:
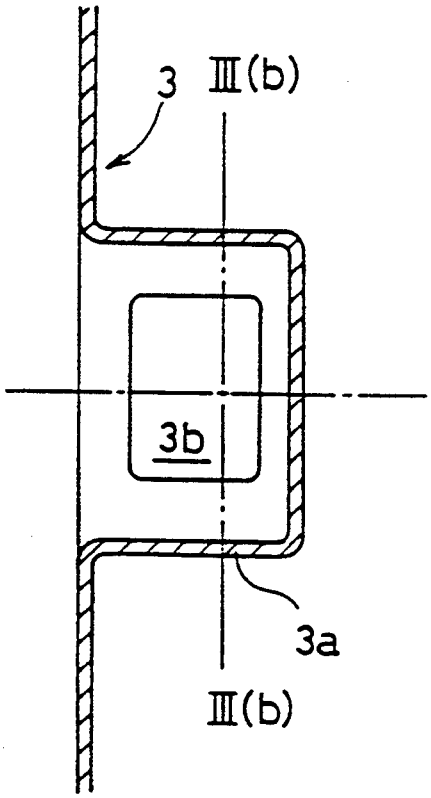
FIG. 3(*a*) is a cross-sectional view of a cylindrical portion of a partition wall of the pump casing made of sheet metal shown in FIG. 1.
Figure 3B:
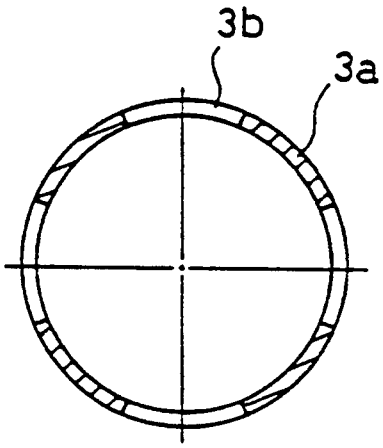

The partition wall 3 has a radial portion whose outer peripheral edge is welded to an inner surface of the cylindrical side wall of the pump casing 2. The partition wall 3 also has a central cylindrical portion 3*a* which axially extends from the radial portion toward the bottom 2*a* of the pump casing 2. The cylindrical portion 3*a* has a plurality of rectangular suction holes 3*b* defined in its cylindrical side wall at circumferentially spaced positions as also shown in FIGS. 3(*a*) and 3(*b*). The cylindrical portion 3*a* has its bottom connected to the bottom 2*a* of the pump casing 2 by spot welding or the like. Since the outer peripheral edge of the partition wall 3 is fixed to the cylindrical side wall of the pump casing 2 and the bottom of the cylindrical portion 3*a* is fixed to the bottom 2*a* of the pump casing 2, the partition wall 3 has large mechanical strength and rigidity sufficient to withstand the load applied thereto due to the difference between the pressure of a fluid drawn into the suction chamber 4 and the pressure of a fluid discharged from the hydrocasing chamber 5. The plural suction holes 3*b* defined in the cylindrical side wall of the cylindrical portion 3*a* are effective to make uniform the fluid flows that are directed toward an inlet region of the impeller 6.

Figure 4A:
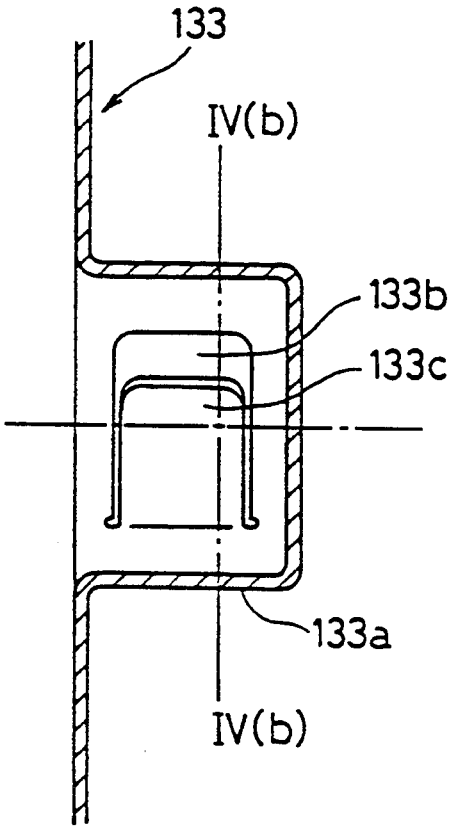
FIG. 4(*a*) is a cross-sectional view of a cylindrical portion of a partition wall according to another embodiment of the present invention.
Figure 4B:
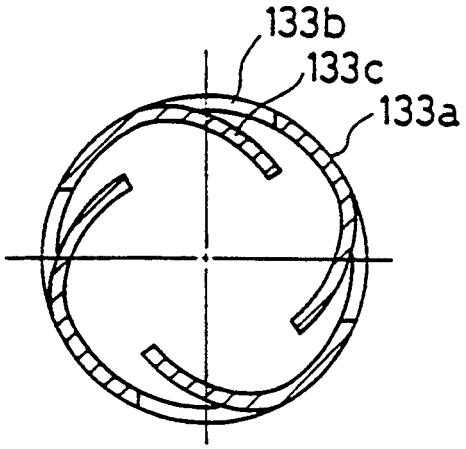

FIGS. 4(*a*) and 4(*b*) show a cylindrical portion 133*a* of a partition wall 133 according to another embodiment of the present invention. In FIGS. 4(*a*) and 4(*b*), the cylindrical portion 133 has a plurality of substantially U-shaped circumferentially spaced tongues 133*c* defined in its cylindrical side wall and raised radially inwardly therefrom, defining respective suction holes 133*b* in the cylindrical side wall.

Figure 5A:
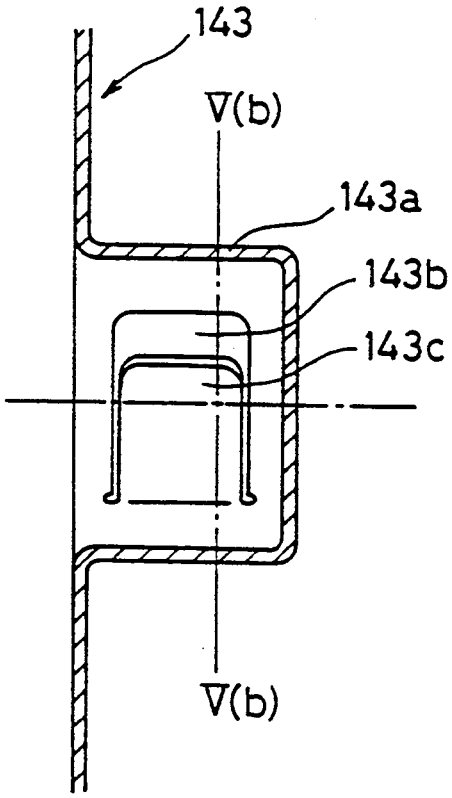
FIG. 5(*a*) is a cross-sectional view of a cylindrical portion of a partition wall according to still another embodiment of the present invention.
Figure 5B:
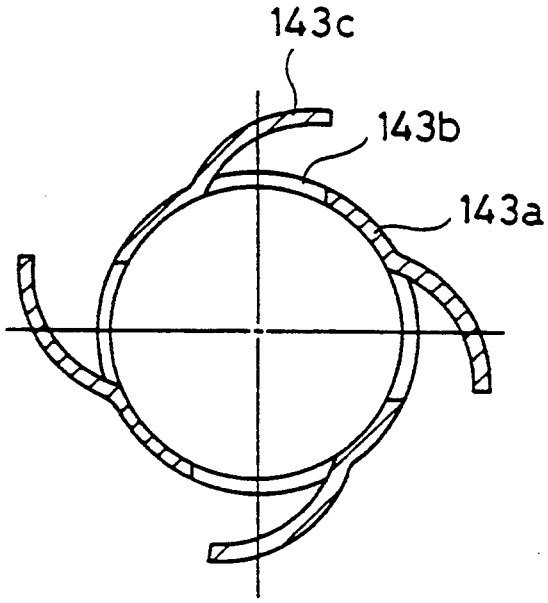

FIGS. 5(*a*) and 5(*b*) illustrates a cylindrical portion 143*a* of a partition wall 143 according to still another embodiment of the present invention. In FIGS. 5(*a*) and 5(*b*), the cylindrical portion 143 has a plurality of substantially U-shaped circumferentially spaced tongues 143*c* defined in its cylindrical side wall and raised radially outwardly therefrom, defining respective suction holes 143*b* in the cylindrical side wall.

In the embodiments shown in FIGS. 4(*a*), 4(*b*) and 5(*a*), 5(*b*), the U-shaped tongues 133*c*, 143*c* serve as guide members for forming a whorled fluid flow and drawing a fluid more effectively from the suction chamber into the cylindrical portions 133*a*, 143*b*.

As shown in FIG. 1, the pump casing 2 has a tubular suction nozzle 10 and a tubular discharge nozzle 11 mounted on its cylindrical side wall in diametrically opposite relationship to each other and projecting radially outwardly. Annular suction and discharge flanges 15, 16 are mounted on and project radially outwardly from the respective tubular suction and discharge nozzles 10, 11 with intermediate rings 14 joined therebetween. The intermediate rings 14 are made of the same material as the pump casing 2, such as stainless steel. Each of the intermediate rings 14 is of an L-shaped cross section and has a central circular opening 14*a* defined therein, an annular recess 14*b* opening inwardly toward the impeller 6, an externally threaded outer surface 14*c* facing radially outwardly, and a seal surface 14*c* on an axial end thereof for mating engagement with a flange (not shown) of a device to be coupled to the line pump. The suction nozzle 10 has a larger-diameter portion 10*a* and a smaller-diameter outer end 10*b* extending outwardly from the larger-diameter portion 10*a*. The smaller-diameter portion 10*b* is disposed in the opening 14*a* and welded to a surface defining the opening 14*a* of one of the intermediate rings 14 in a socket-and-spigot joint. The recess 14*b* receives the larger-diameter portion 10*a* of the suction nozzle 10 which is welded to an axial end of the intermediate ring 14 in a socket-and-spigot joint. Similarly, the discharge nozzle 11 has a larger-diameter portion 11*a* and a smaller-diameter outer end 11*b* extending outwardly from the larger-diameter portion 11*a*. The smaller-diameter portion 11*b* is disposed in the opening 14*a* and welded to a surface defining the opening 14*a* of the other intermediate ring 14 in a socket-and-spigot joint. The recess 14*b* receives the larger-diameter inner portion 11*a* of the discharge nozzle 11 which is welded to an axial end of the intermediate ring 14 in a socket-and-spigot joint. The suction and discharge flanges 15, 16 have internally threaded inner surfaces, respectively, threaded over the externally threaded surfaces 14*c* of the intermediate rings 14. The suction and discharge flanges 15, 16, which are not held in contact with a fluid that is handled by the line pump, are made of a material different from the pump casing 2 itself, e.g., cast iron (FC) or the like.

Figure 6A:
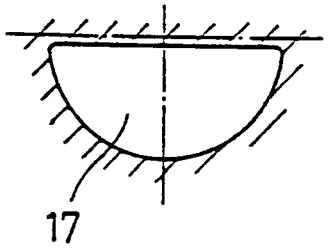
FIG. 6(*a*) is a side elevational view of a suction port as viewed in the direction indicated by the arrow VI(*a*) in FIG. 1.
Figure 6B:
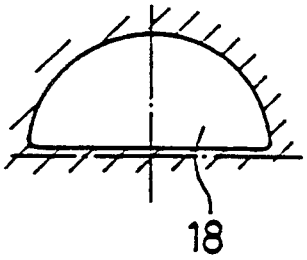

The suction and discharge nozzles 10, 11 are positioned axially over the suction chamber 4 and the hydrocasing chamber 5, respectively. The cylindrical side wall of the pump casing 2 has a suction port 17 defined therein which provides communication between the suction chamber 4 and the suction nozzle 10, and a discharge port 18 defined therein which provides communication between the hydrocasing chamber 5 and the discharge nozzle 11. The suction and discharge ports 17, 18 are positioned in axially staggered relationship, i.e., the suction port 17 is positioned on one side of the plane of the radial portion of the partition wall 3, remote from the motor, and the discharge port 18 is positioned on the other side of the plane of the radial portion of the partition wall 3, closer to the motor. As shown in FIGS. 6(*a*) and 6(*b*), the suction and discharge ports 17, 18 are of a substantially semicircular shape whose center of curvature is located near the welded peripheral edge of the partition wall 3. The ratio of the (identical) inside diameters $D_N$ of the larger-diameter portions 10*a*, 11*a* of the suction and discharge nozzles 10, 11 to the pump inlet or outlet diameter $\phi$ is selected to satisfy the range: $D_N/\phi \leqq 1.4$ in order to maintain desired opening areas of the suction and discharge ports 17, 18. Therefore, the opening areas of the suction and discharge ports 17, 18 are the same as or greater than the pump inlet or outlet diameter $\phi$.

In the hydrocasing chamber 5 of the pump casing 2, there is disposed an inner casing 19 which is formed by pressing sheet steel such as stainless steel according to the deep drawing process. The inner casing 19 comprises a cylindrical cup-shaped casing body 19*a* and a cylindrical suction portion 19*b* extending axially from the casing body 19*a* into the suction region of the impeller 6. The impeller 6 is housed in the inner casing 19. An annular discharge passage is defined around the casing body 19*a* in the opening of the pump casing 2 which is closed by the casing cover 8, the annular discharge passage communicating with the discharge port 18 via openings 19*c* in the inner casing. The casing body 19*a* has an open end remote from the cylindrical suction portion 19*b* and fitted over an annular shoulder of the casing cover 8. The casing cover 8 is in turn supported on a motor bracket 20 which is in the form of a casting. Therefore, the inner casing 19 is supported on the casing cover 8 which is rendered highly rigid by the motor bracket 20. The cylindrical suction portion 19*b* of the inner casing 19 has an axial distal end extending in the vicinity of the partition wall 3. A resilient seal 21 is located in an annular gap between the distal end of the cylindrical suction portion 19*b* and the partition wall 3. The resilient seal 21 seals a suction side (low-pressure side), i.e., the suction chamber 4, in the line pump from a discharge side (high-pressure side), i.e., the hydrocasing chamber 5, in the line pump. Since the resilient seal 21 is wedged into the discharge side of the annular gap and is pulled farther into the gap in a direction toward the suction side under the differential pressure between the suction and discharge sides, the resilient seal 21 is reliably retained in place.

A guide device 23, which defines guide vanes or a volute, is mounted on a radially inner surface of the casing body 19*a* of the inner casing 19. The cylindrical suction portion 19*b* of the inner casing 19 serves as a liner portion, and a slight clearance is defined between the liner portion and a peripheral edge of the end of the impeller 6 in its suction region.

The line pump of the above structure operates as follows: fluid drawn from the suction nozzle 10 is sucked through the suction port 17 into the suction chamber 4. The fluid is then introduced through the suction openings 3*b* of the partition wall 3 and the suction portion 19*b* of the inner casing 19 into the impeller 6, which rotates to discharge the fluid under a higher pressure. The pressure of the fluid discharged from the impeller 6 is recovered by the guide device 23. Thereafter, the fluid flows from openings 19*c* defined in the casing body 19*a* into the annular discharge passage, from which the fluid is discharged through the discharge port 18 and the discharge nozzle 11 into a discharge pipe (not shown) coupled to the discharge flange 16. The fluid that has flowed into the space between the pump casing 2 and the inner casing 19 is prevented from leaking back into the suction side by the resilient seal 21.

Since the interior space of the substantially cylindrical cup-shaped pump casing 2 is divided into the suction chamber 4 and the hydrocasing chamber 5 by the partition wall 3, the pump casing 2 is of a simple configuration that does not depend on the hydrocasing chamber 5. Therefore, the pump casing 2 can easily be pressed to desired shape, and the suction chamber 4 and the hydrocasing chamber 5 can be separated from each other by the partition wall 3 that is also a simple shape. The number of parts used is relatively small, and they can easily be welded together.

The suction and discharge nozzles 10, 11 are positioned one on each side of the partition wall 3. The partition wall 3 may thus be simplified in shape and easily be pressed to shape. The partition wall 3 provides a desired level of rigidity against the pressure difference between the suction and discharge sides.

Inasmuch as each of the suction and discharge nozzles 10, 11 has portions of different diameters, they can provide a necessary opening area for the suction and discharge ports 17, 18, and are sufficiently rigid. The resilient seal 21 interposed between the pump casing 2 and the inner casing 19 is effective to absorb deformations of the pump casing 2 which may be caused by external forces applied thereto, and hence to prevent such deformations from deforming the inner casing 19.

Next, a pump casing made of sheet metal according to another embodiment of the present invention will be described below with reference to FIGS. 7 and 8.

Figure 7:
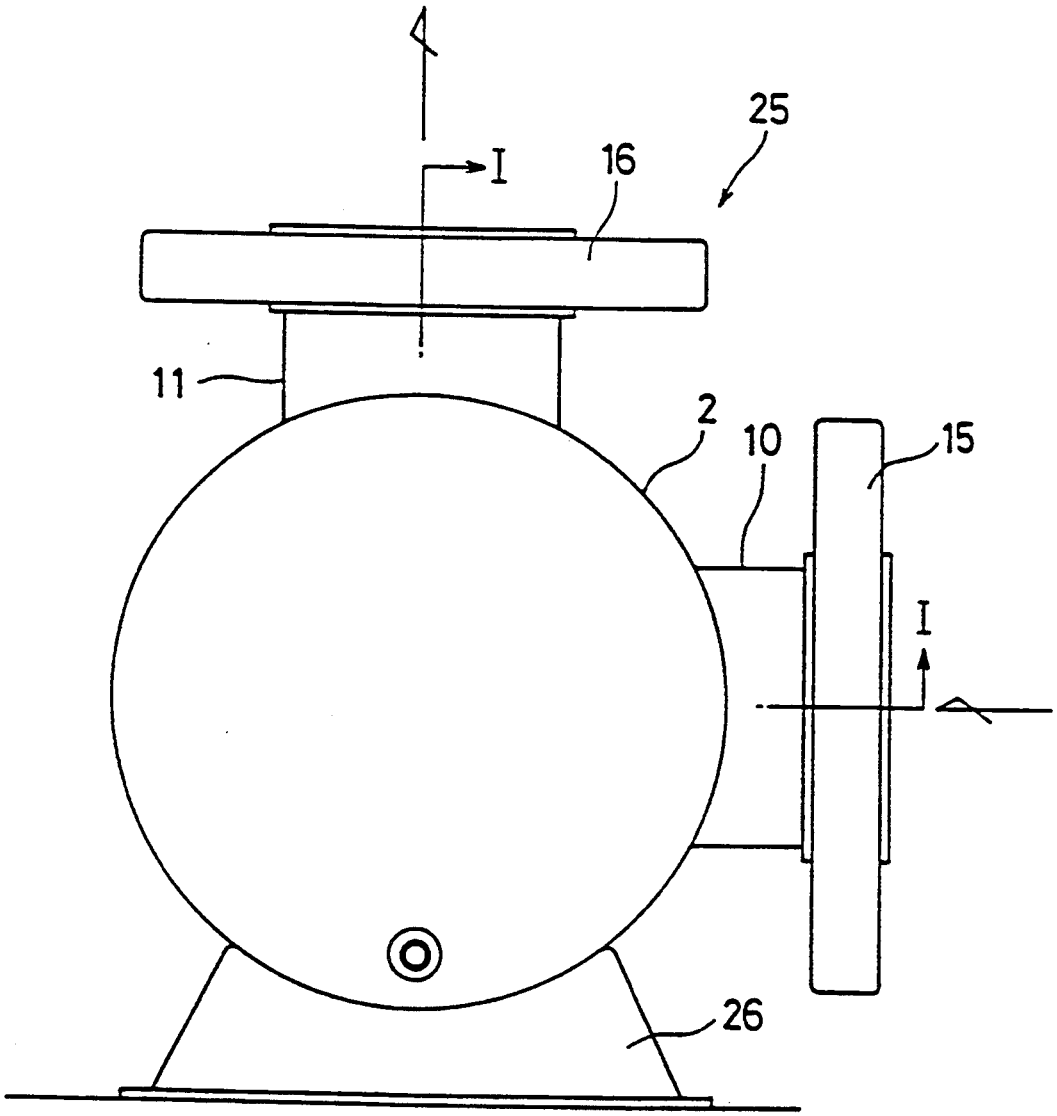
FIG. 7 is a side view of a pump casing made of sheet metal according to another embodiment of the present invention.

FIG. 7 shows a ground-installed side-top type of centrifugal pump having a pump casing according to the present invention. In this specification, a side-top type of centrifugal pump in defined as a pump having a pump casing which is provided with a suction nozzle on the side of the cylindrical side wall and a discharge nozzle on the top of the cylindrical side wall.

As shown in FIG. 7, the side-top type of centrifugal pump 25 has a pump casing 2 which is provided with a leg 26, a suction nozzle 10 and a discharge nozzle 11 on the cylindrical side wall thereof. The leg 26 is provided on the bottom of the cylindrical side wall, the suction nozzle 10 is provided on the side of the cylindrical side wall, and the discharge nozzle 11 is provided on the top of the cylindrical side wall. A cross-sectional view taken along line I—I of FIG. 7 is the same as FIG. 1, therefore the interior structure of the pump 25 will not be described.

There have also been known end-top type of centrifugal pumps which have a suction nozzle extending horizontally from a front wall of a pump casing and a discharge nozzle extending vertically upwardly from the cylindrical side wall of the pump casing.

Figure 8A:
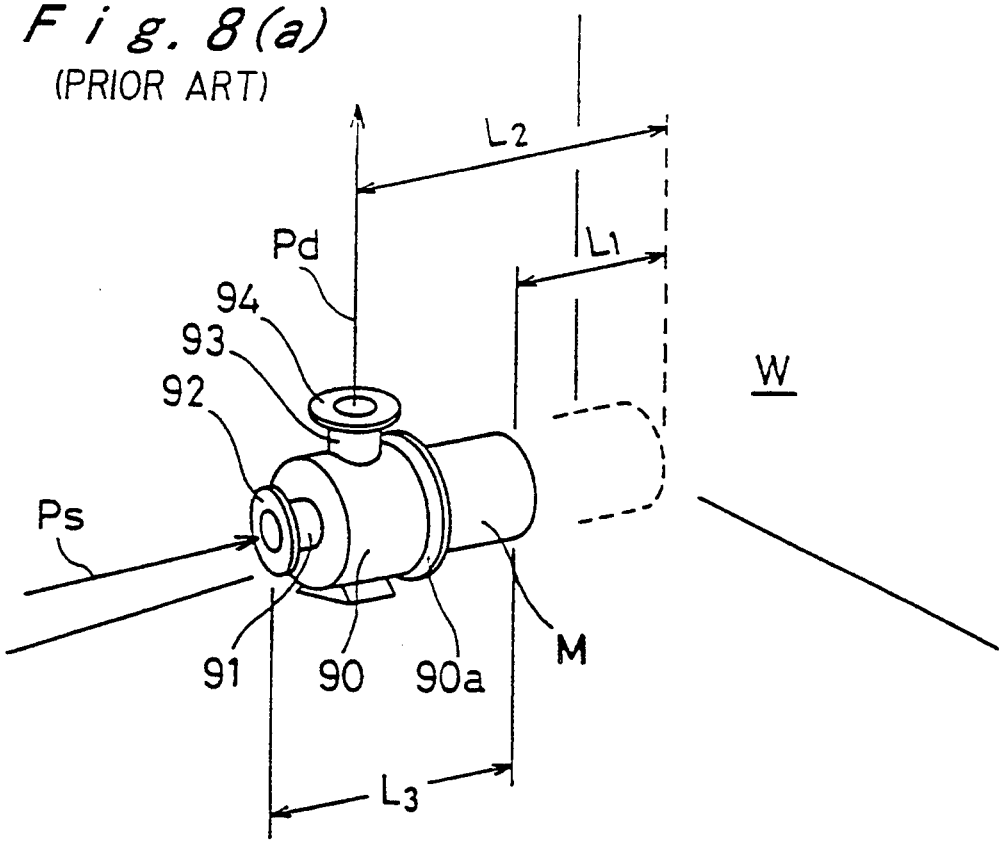
Fig. 8(a) (PRIOR ART)
FIG. 8(*a*) is a perspective view of a conventional end-top type of pump casing.
Figure 8B:
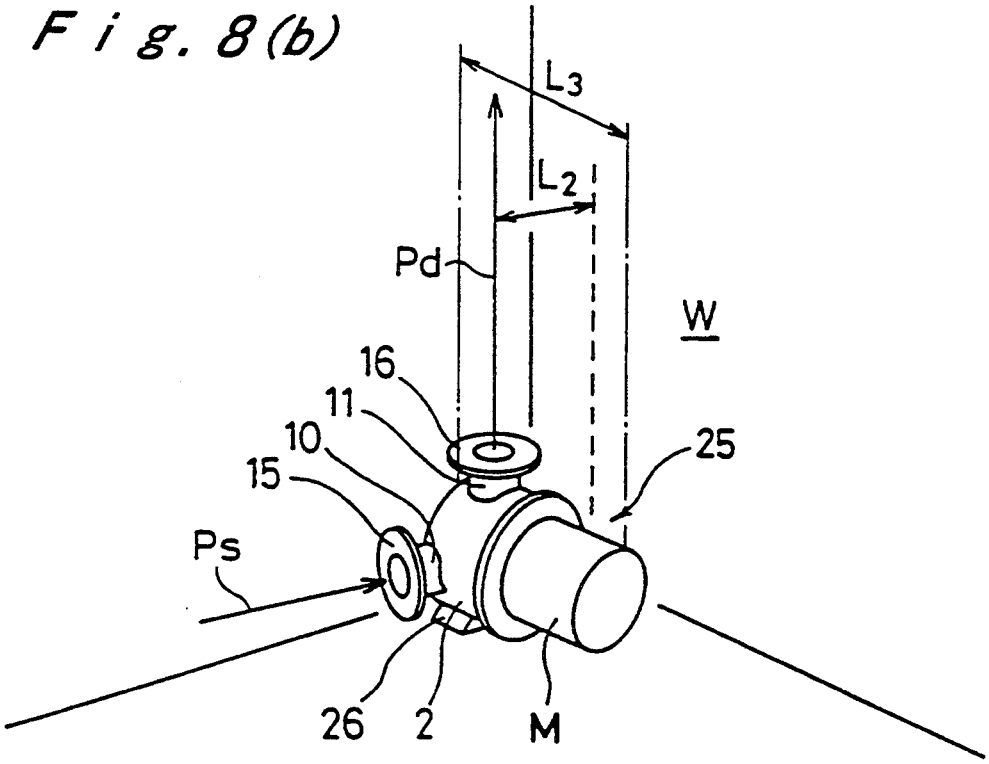
Figure 9:
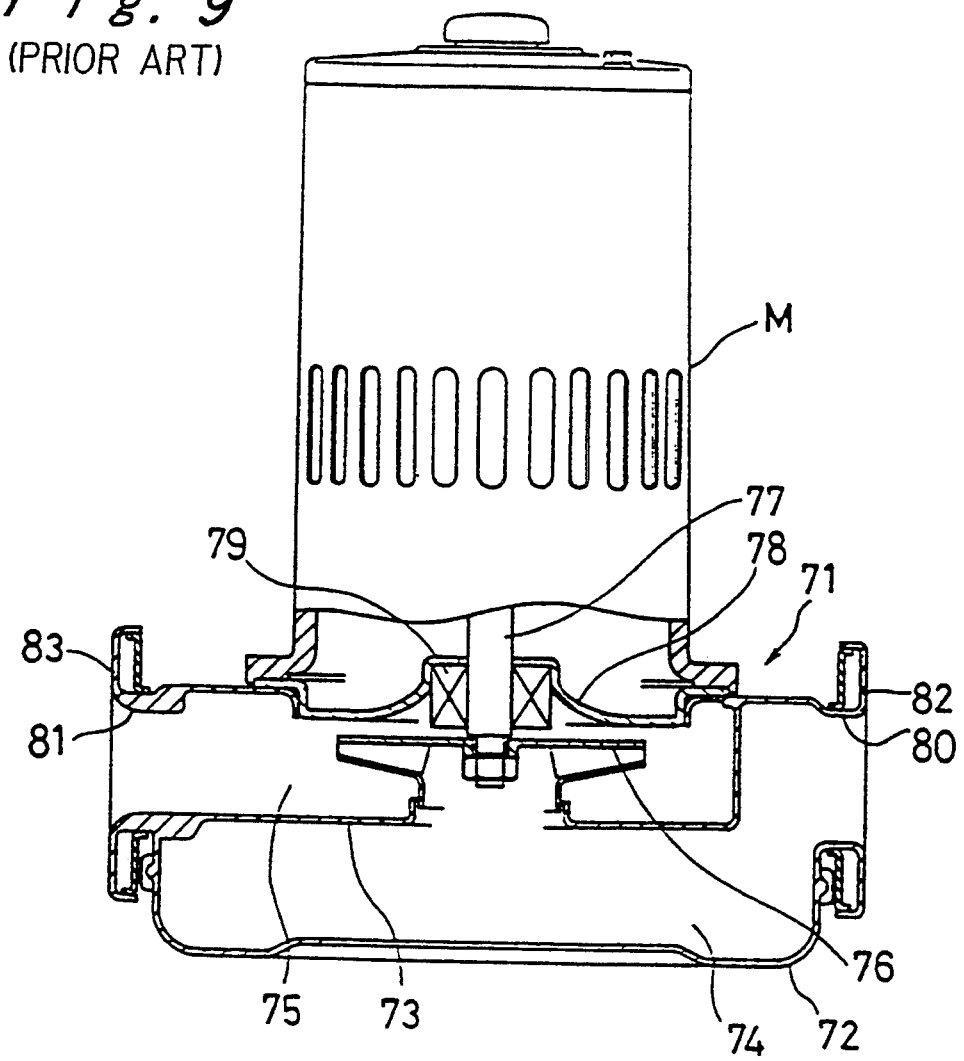
Fig. 9 (PRIOR ART)
FIG. 9 is a vertical cross-sectional view of a conventional line pump having a pump casing made of sheet metal.
Figure 10:
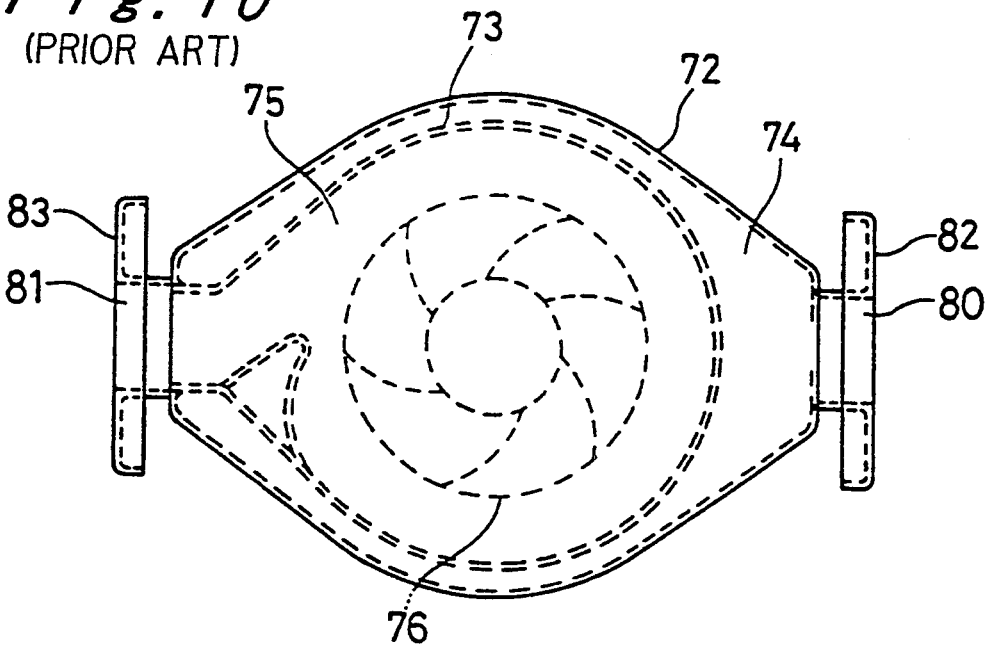
Fig. 10 (PRIOR ART)
FIG. 10 is a bottom view of the line pump shown in FIG. 9.

As shown in FIG. 8(*a*), the end-top type of centrifugal pump has a cylindrical cup-shaped pump casing 90 having a front wall and a cylindrical side wall. A suction nozzle 91 having a suction flange 92 extends forwardly from the front wall of the pump casing 90, and a discharge nozzle 93 having a discharge flange 94 extends upwardly from the cylindrical side wall of the pump casing 90. The pump casing 90 has a casing flange 90*a* at the open end thereof, to which a motor M is connected.

According to the end-top type of centrifugal pump thus constructed, a discharge pipe $P_d$ connected to the discharge flange 94 must be spacedly disposed from a wall W by a distance corresponding to the length of the motor M plus a space $L_1$ for disassembling and checking. Therefore, the dimension (or length) $L_2$ from the wall W to the discharge pipe $P_d$ becomes long, the pump cannot be placed at the corner of a room and the discharge pips $P_d$ cannot be disposed in close proximity to the wall W, resulting in inefficient space utilization. Since the suction nozzle extends forwardly from the front wall of the pump casing, the total length $L_3$ of the pump becomes long, also resulting in inefficient space utilization.

However, the side-top type of centrifugal pump 25 shown in FIG. 7 can be placed in close proximity to the wall W as shown in FIG. 8(*b*). As is apparent from FIG. 8(*b*), according to the embodiment, the suction nozzle 10 and the discharge nozzle 11 can be provided on the cylindrical side wall, thereby constituting a side-top type of centrifugal pump. The suction nozzle 10 extends horizontally from the cylindrical side wall of the pump casing 2, and does not extend forwardly from the front side of the pump casing. Therefore, the dimension (or length) $L_2$ from the wall W to the discharge pipe $P_d$ becomes short, the pump can be placed at the corner of the room, and the suction pipe P, and the discharge pipe $P_d$ can be disposed in close proximity to the wall W. Further, the total length $L_3$ of the pump becomes short.

According to the present invention, a common pump casing can be used for a line pump (FIG. 1) and a side-top type of centrifugal pump (FIG. 7) by providing a suction nozzle and/or a discharge nozzle.

Although certain preferred embodiments of the present invention have been shown and described in detail, it should be understood that various changes and modifications may be made therein without departing from the scope of the appended claims.

What is claimed as new and desired to be secured by Letters Patent of the United States is:

1. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller;

a suction nozzle mounted on a cylindrical side wall of said pump casing and communicating with said suction chamber; and guide device comprised by guide vanes, for guiding fluid discharged from said impeller.

2. The pump casing made of sheet metal according to claim 1, wherein said suction nozzle is positioned outside of said suction and hydrocasing chambers, further comprising a discharge nozzle mounted on said cylindrical side wall of said pump casing and positioned outside of said suction and hydrocasing chambers, said cylindrical side wall having a suction port defined thereon which provides communication between said suction chamber and said suction nozzle, and a discharge port defined thereon which provides communication between said hydrocasing chamber and said discharge nozzle.

3. The pump casing made of sheet metal according to claim 2, wherein each of said suction nozzle and said discharge nozzle has a smaller-diameter portion and a larger-diameter portion extending therefrom, the larger diameter portion being connected to said cylindrical side wall of said pump casing, said suction and discharge ports being positioned on mutually opposite sides of a plane defined by said partition wall, each of said suction and discharge ports having a substantially semicircular shape having a center of curvature substantially at said partition wall.

4. The pump casing made of sheet metal according to claim 2, wherein longitudinal axes of said suction nozzle and said discharge nozzle are positioned in line with each other.

5. The pump casing made of sheet metal according to claim 2, wherein longitudinal axes of said suction nozzle and said discharge nozzle are positioned substantially perpendicularly to each other.

6. The pump casing made of sheet metal according to claim 1, further comprising an inner casing disposed in said hydrocasing chamber of said pump casing, said inner casing housing an impeller.

7. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller, said partition wall being connected to said bottom of said pump casing;

a suction nozzle mounted on a cylindrical side wall of said pump casing and communicating with said suction chamber;

an inner casing disposed in said hydrocasing chamber of said pump casing in spaced relationship to said partition wall to define a gap, said inner casing housing an impeller when said pump casing is mounted to a pump having the impeller; and a resilient seal disposed in the gap defined between said inner casing and said partition wall.

8. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller, said partition wall being connected to said bottom of said pump casing; and a suction nozzle mounted on a cylindrical side wall of said pump casing and communicating with said suction chamber;

wherein said partition wall has a cylindrical suction portion having a guide plate for forming a whorled flow of a fluid sucked therethrough.

9. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller;

a suction nozzle mounted on a cylindrical side wall of said pump casing and communicating with said suction chamber; and a guide device comprised by guide vanes volute, for guiding fluid discharged from said impeller;

wherein said partition wall has a central projecting portion which axially extends toward a bottom of said pump casing and has a tip end contacting said bottom of said pump casing, and said central projecting portion having at least one suction hole for introducing fluid.

10. The pump casing made of sheet metal according to claim 9, wherein said suction nozzle is positioned outside of said suction and hydrocasing chambers, further comprising a discharge nozzle mounted on said cylindrical side wall of said pump casing and positioned outside of said suction and hydrocasing chambers, said cylindrical side wall having a suction port defined thereon which provides communication between said suction chamber and said suction nozzle, and a discharge port defined thereon which provides communication between said hydrocasing chamber and said discharge nozzle.

11. The pump casing made of sheet metal according to claim 9, wherein each of said suction nozzle and said discharge nozzle has a smaller-diameter portion and a larger-diameter portion extending therefrom, the larger diameter portion being connected to said cylindrical side wall of said pump casing, said suction and discharge ports being positioned on mutually opposite sides of a plane defined by said partition wall, each of said suction and discharge ports having a substantially semicircular shape having a center of curvature substantially at said partition wall.

12. The pump casing made of sheet metal according to claim 9, wherein longitudinal axes of said suction nozzle and said discharge nozzle are positioned in line with each other.

13. The pump casing made of sheet metal according to claim 9, wherein longitudinal axes of said suction nozzle and said discharge nozzle are positioned substantially perpendicularly to each other.

14. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller; and a suction nozzle mounted on a cylindrical side wall of said pump casing and communicating with said suction chamber;

wherein said partition wall is substantially symmetrical about an axis of said pump casing and has a radial portion whose outer peripheral edge is supported by an inner surface of said cylindrical side wall of said pump casing.

15. The pump casing made of sheet metal according to claim 14, wherein said suction nozzle is positioned outside of said suction and hydrocasing chambers, further comprising a discharge nozzle mounted on said cylindrical side wall of said pump casing and positioned outside of said suction and hydrocasing chambers, said cylindrical side wall having a suction port defined thereon which provides communication between said suction chamber and said suction nozzle, and a discharge port defined thereon which provides communication between said hydrocasing chamber and said discharge nozzle.

16. The pump casing made of sheet metal according to claim 14, wherein each of said suction nozzle and said discharge nozzle has a smaller-diameter portion and a larger-diameter portion extending therefrom, the larger diameter portion being connected to said cylindrical side wall of said pump casing, said suction and discharge ports being positioned on mutually opposite sides of a plane defined by said partition wall, each of said suction and discharge ports having a substantially semicircular shape having a center of curvature substantially at said partition wall.

17. The pump casing made of sheet metal according to claim 14, wherein longitudinal axes of said suction nozzle and said discharge nozzle are positioned in line with each other.

18. The pump casing made of sheet metal according to claim 14, wherein longitudinal axes of said suction nozzle and said discharge nozzle are positioned substantially perpendicularly to each other.

19. The pump casing made of sheet metal according to claim 14, further comprising an inner casing disposed in said hydrocasing chamber of said pump casing, said inner casing housing an impeller.

20. A pump casing made of sheet metal, comprising:

a substantially cylindrical cup-shaped pump casing made of sheet metal and having a bottom on one axial end thereof and an opening defined in an opposite axial end thereof;

a partition wall disposed in said pump casing for partitioning said pump casing into a suction chamber and a hydrocasing chamber for housing an impeller; and a suction nozzle mounted on a cylindrical side wall of said pump casing and communicating with said suction chamber;

wherein said partition wall is substantially symmetrical about an axis of said pump casing, and has a radial portion whose outer peripheral edge is supported by an inner surface of said cylindrical side wall of said pump casing and a central projecting portion which axially extends toward a bottom of said pump casing and has a tip end contacting said bottom of said pump casing, and said central projecting portion has at least one suction hole for introducing fluid.

21. The pump casing made of sheet metal according to claim 20, wherein said suction nozzle is positioned outside of said suction and hydrocasing chambers, further comprising a discharge nozzle mounted on said cylindrical side wall of said pump casing and positioned outside of said suction and hydrocasing chambers, said cylindrical side wall having a suction port defined thereon which provides communication between said suction chamber and said suction nozzle, and a discharge port defined thereon which provides communication between said hydrocasing chamber and said discharge nozzle.

22. The pump casing made of sheet metal according to claim 20, wherein each of said suction nozzle and said discharge nozzle has a smaller-diameter portion and a larger-diameter portion extending therefrom, the larger diameter portion being connected to said cylindrical side wall of said pump casing, said suction and discharge ports being positioned on mutually opposite sides of a plane defined by said partition wall, each of said suction and discharge ports having a substantially semicircular shape having a center of curvature substantially at said partition wall.

23. The pump casing made of sheet metal according to claim 20, wherein longitudinal axes of said suction nozzle and said discharge nozzle are positioned in line with each other.

24. The pump casing made of sheet metal according to claim 20, wherein longitudinal axes of said suction nozzle and said discharge nozzle are positioned substantially perpendicularly to each other.

25. The pump casing made of sheet metal according to claim 20, including an impeller in said hydrocasing chamber and driven by a motor, further comprising an outer cylinder provided around the motor for driving the impeller, wherein an annular fluid passage is defined between said outer cylinder and the motor, and wherein said hydrocasing chamber of said pump casing defines an annular discharge passage which is communicated with said annular fluid passage.

26. The pump casing made of sheet metal according to claim 20, further comprising an inner casing disposed in said hydrocasing chamber of said pump casing, said inner casing housing an impeller.

* * * * *